United States Patent [19]

Sibler

[11] 4,342,212

[45] Aug. 3, 1982

[54] INDIRECT EXTRUSION PRESS

[75] Inventor: Guenter W. Sibler, Pittsburgh, Pa.

[73] Assignee: Sutton Engineering Company, Pittsburgh, Pa.

[21] Appl. No.: 183,230

[22] Filed: Sep. 2, 1980

[51] Int. Cl.[3] ..... B21C 23/00; B21C 33/00; B21C 35/04

[52] U.S. Cl. ..... 72/255; 72/263; 72/270; 72/273.5

[58] Field of Search ..... 72/263, 273.5, 255, 72/254, 270

[56] References Cited

U.S. PATENT DOCUMENTS

| | | | |
|---|---|---|---|
| 2,914,171 | 11/1959 | Hoffman et al. | 72/255 |
| 2,954,869 | 10/1960 | Swanson | 72/263 |
| 3,533,265 | 10/1970 | Valks | 72/255 |
| 3,577,759 | 5/1971 | Tandler et al. | 72/254 |
| 4,213,318 | 7/1980 | Priebe | 72/273.5 |

FOREIGN PATENT DOCUMENTS

| | | | |
|---|---|---|---|
| 2843178 | 4/1979 | Fed. Rep. of Germany | 72/273.5 |
| 54-1662 | 1/1979 | Japan | 72/273.5 |
| 897040 | 5/1962 | United Kingdom | 72/263 |
| 459280 | 2/1975 | U.S.S.R. | 72/254 |

*Primary Examiner*—Lowell A. Larson

*Attorney, Agent, or Firm*—Brown, Flick & Peckham

[57] ABSTRACT

A die stem and a billet-receiving sleeve extend rearwardly from an extrusion apparatus platen slide that is movable laterally from a first position in which the stem is aligned with a billet container passage behind it to a second position in which the sleeve is aligned with the passage. An extrusion stem behind the container is movable forward through the passage, and there is means behind the sleeve in the first position for pushing a hot billet into the sleeve. A die slide carried by the container and holding a die is movable laterally across the container from an inner position aligned with the container passage when the platen slide is in its first position to an outer position aligned with the die stem in the second position of the platen slide. In the sleeve there is means for pushing a billet out of the sleeve in the second position of the platen slide and into the container as the container is moved forward toward the sleeve.

1 Claim, 14 Drawing Figures

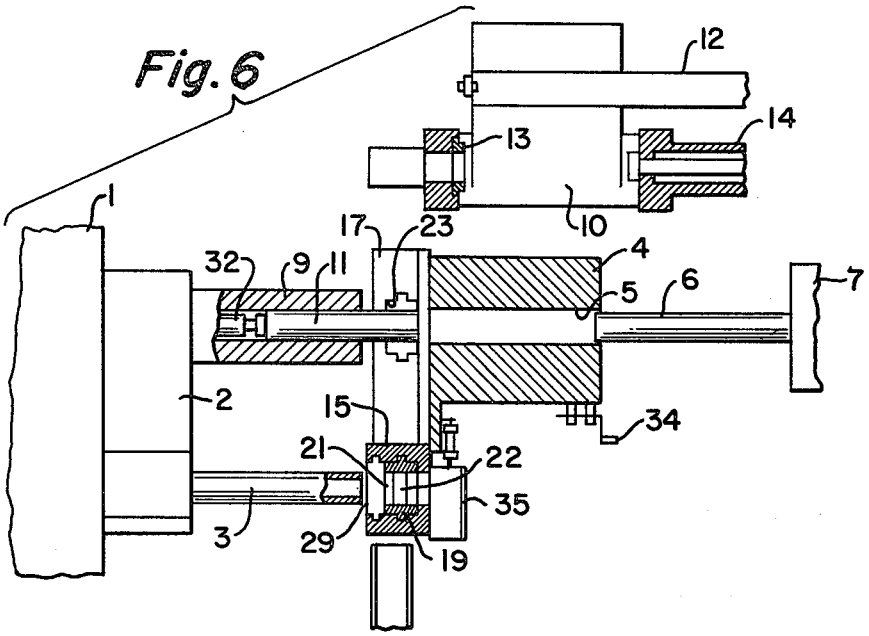
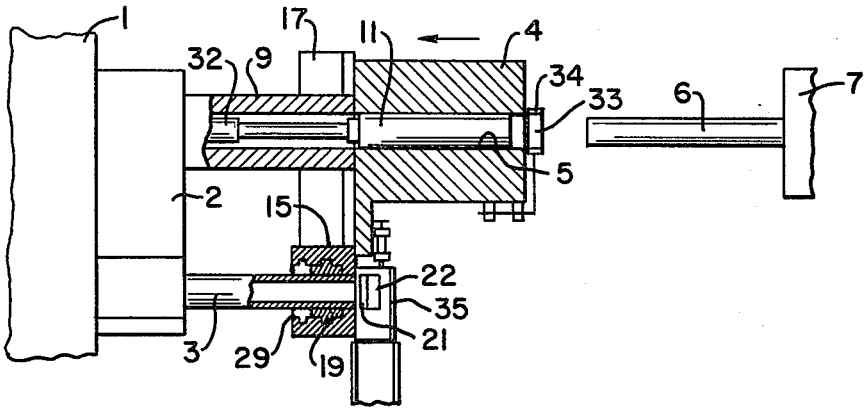
Fig. 7
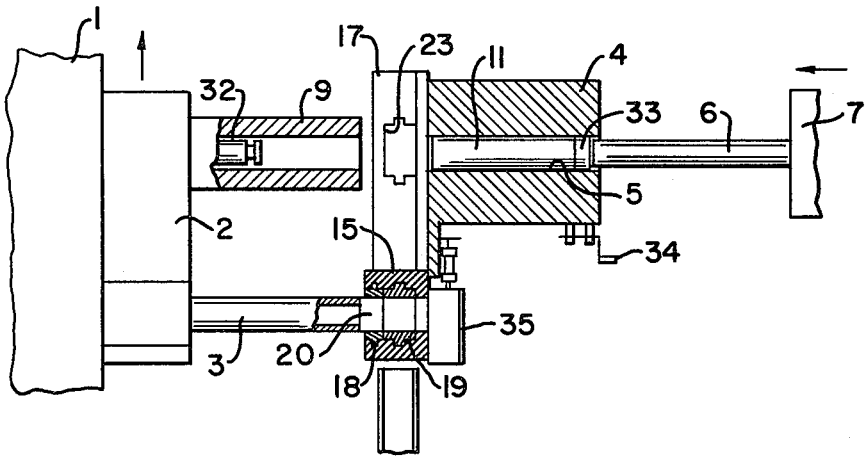
Fig. 8

INDIRECT EXTRUSION PRESS

It is among the objects of this invention to provide an indirect extrusion press which is combined with a billet scalping press, which requires less floor space than heretofore, which has a high production rate and which straightens a billet immediately after scalping when necessary.

The preferred embodiment of the invention is illustrated in the accompanying fragmentary drawings, in which it is shown somewhat schematically.

FIGS. 6, 7, 8, 9, 10 and 11 are views similar to FIG. 1 at successive stages in loading and extruding the billet;

Figure 1:
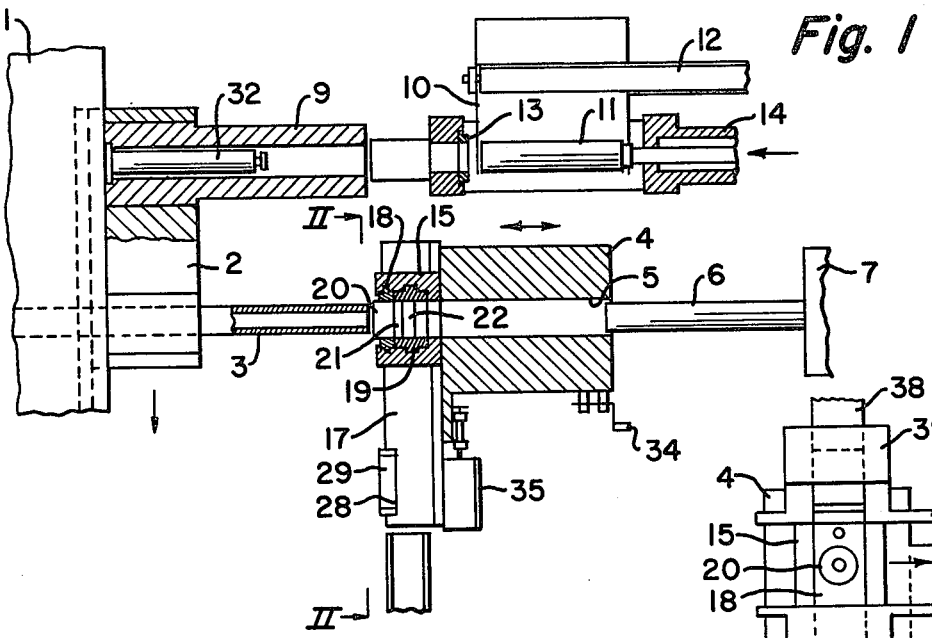
FIG. 1 is a horizontal section showing a billet about to be delivered to a platen slide.

Referring to FIG. 1 of the drawings, an extrusion press platen 1 is provided with a slide 2 that can be moved back and forth across its rear face in any suitable manner (not shown), such as by hydraulic cylinder. A tubular die stem 3 projecting behind the platen is secured at its front end to one end of the slide. The slide is provided with a passage therethrough in line with the stem and with a passage through the platen to allow an extrusion to pass through them and emerge from the front of the platen. Behind the die stem there is a billet container 4 provided with a billet-receiving passage 5 therethrough in line with the die stem. The container is movable in a well-known manner toward and away from the platen. An extrusion stem 6 behind the container is movable forward through the container passage in a known manner by a hydraulically operated ram 7.

Mounted in the end of the slide opposite die stem 3 is the front end of a rearwardly extending sleeve 9. The platen slide is movable from a first position (FIG. 1), in which the die stem is aligned with container passage 5, to a second position (FIG. 6) in which sleeve 9 is aligned with the same passage. Behind the sleeve in the first position of the slide there is a table 10, to which a heated billet 11 is delivered through a trough 12 from a furnace into a position in line with the sleeve. In case the billet has not already been scalped, a scalping die 13 is rigidly mounted between table 10 and the sleeve to scalp the billet when it is pushed forward through the die and into the sleeve by means of a hydraulic cylinder 14 behind the table. If the billet is not straight, it will be straightened as it is pushed into the sleeve where there is very little clearance around the billet.

Figure 2:
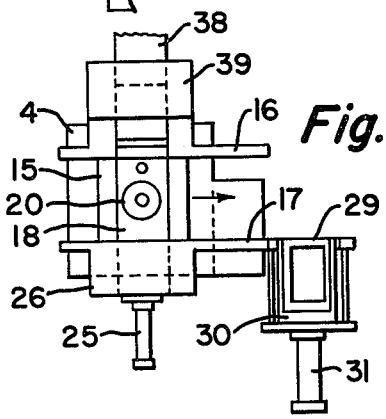
FIG. 2 is a view taken on the line II—II of FIG. 1.
Figure 3:
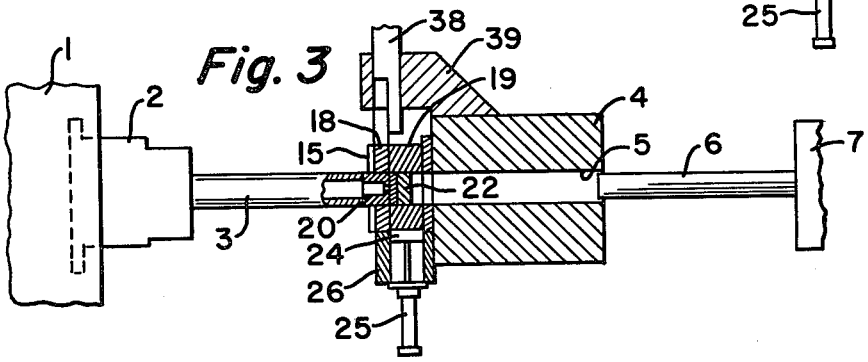
FIG. 3 is a vertical section through the center of the billet container.
Figure 4:
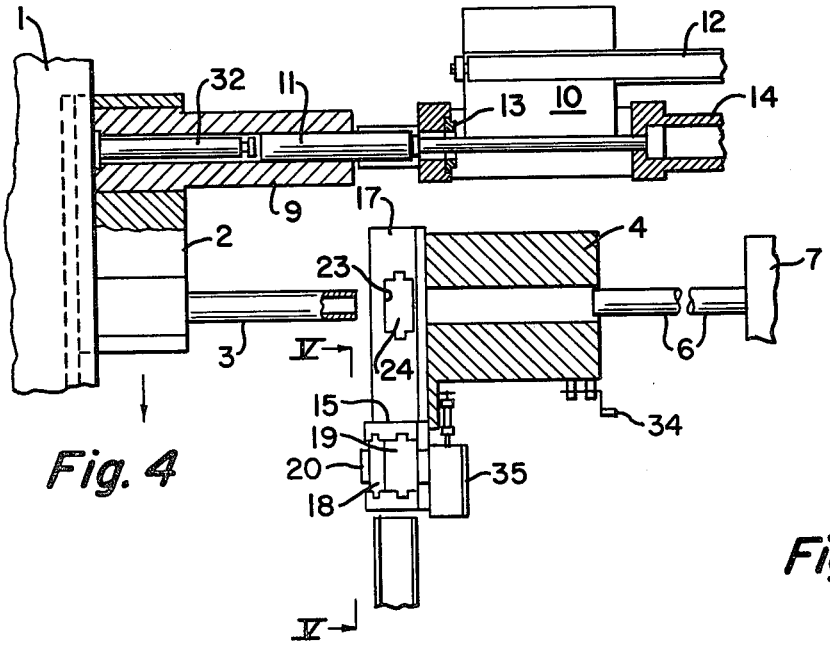
FIG. 4 is a view similar to FIG. 1, but showing the billet delivered to the platen slide.

Slidably mounted in any suitable manner for movement back and forth across the front of the container is a die slide 15 that travels between upper and lower tracks 16 and 17 secured to the container as shown in FIG. 2. When the die slide is in its first or inner position (FIG. 1) the opening extending through it from front to back is aligned with the container passage, and when the slide is in its second or outer position (FIG. 6) it is aligned with die stem 3 when the platen slide is moved to its second position. The die slide is open at its top to receive two cassettes 18 and 19. The one in front carries a removable extrusion die 20, while the other one is adapted to receive an extrusion butt 21 with a dummy block 22 behind it. As shown in FIGS. 3 and 4, beneath the rear cassette 19 the lower track 17 for the die slide has an opening 23 in it of a size and shape that will permit cassette 19 to descend through the track during shearing as will be explained later. The track opening normally is filled by the upper end of a piston 24 that is moved up and down by a fluid pressure cylinder 25 rigidly suspended from a downward extension 26 of the lower track as shown in FIGS. 2 and 3. During extrusion, while the extrusion stem is extruding the billet through the die, the container and die slide are moved forward around the die stem until the die slide engages the platen slide and extension is completed.

Figure 5:
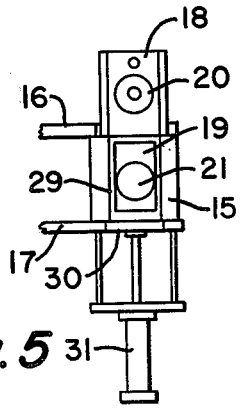
FIG. 5 is a view taken on the line V—V of FIG. 4.

After a scalped billet has been loaded into sleeve 9 by means of cylinder 14 as shown in FIG. 4, the platen slide 2 is moved to its second position shown in FIG. 6 to align the billet with the container passage, the die slide 15 having been moved to its outer position in line with the die stem. If this is the first billet to be extruded there will be no butt nor dummy block in the rear cassette, but if extrusion of another billet has just been completed a butt and block will be in the cassette as shown in FIG. 1. The outer end portion of the lower die slide track 17 is provided with an opening 28 (FIG. 1) that will be beneath the die cassette 18 when it is in its outer position. This opening normally is closed by the upper end of a rectangular frame 29 mounted on the upper end of a piston 30 in a fluid pressure cylinder 31 suspended from the track as shown in FIG. 2. As shown in FIG. 5, the frame is raised by the piston to lift the die cassette high enough to uncover extrusion butt 21 and the opening through the rear cassette 19. While the frame is in its upper position, the die can be changed if desired.

Figure 9:
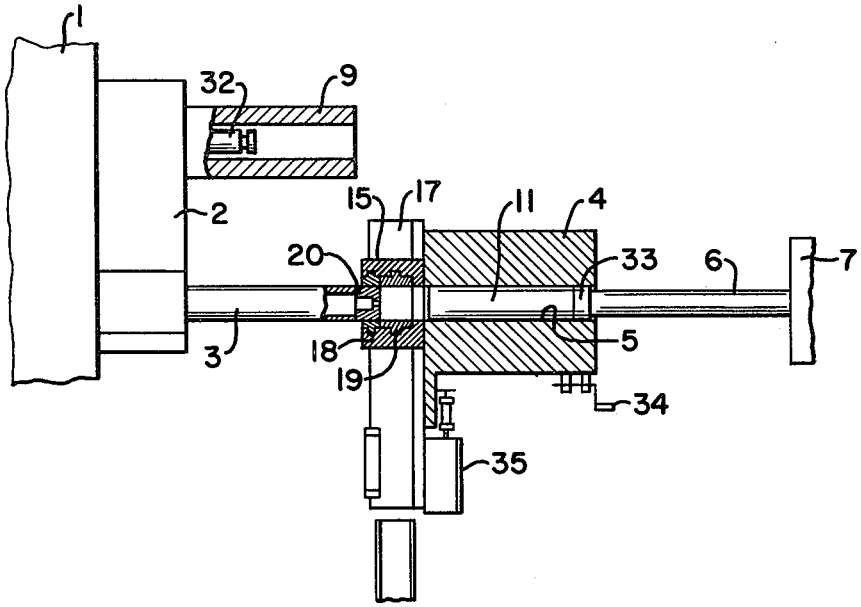
Figure 10:
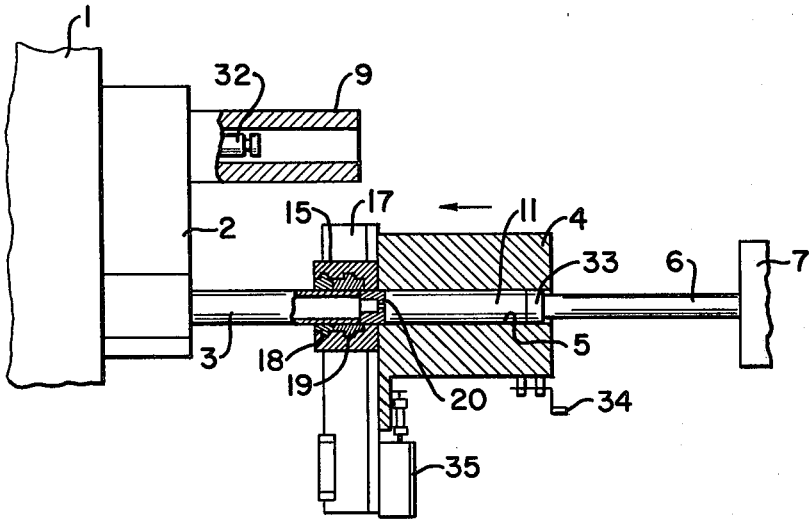
Figure 11:
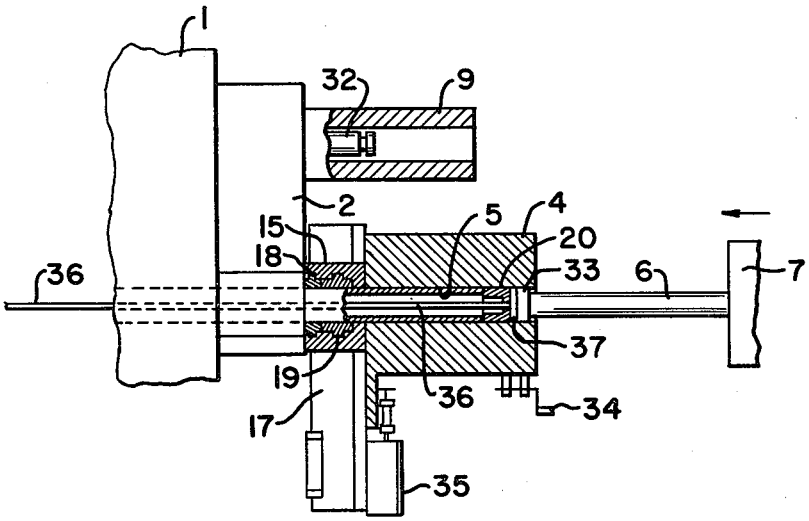
Figure 12:
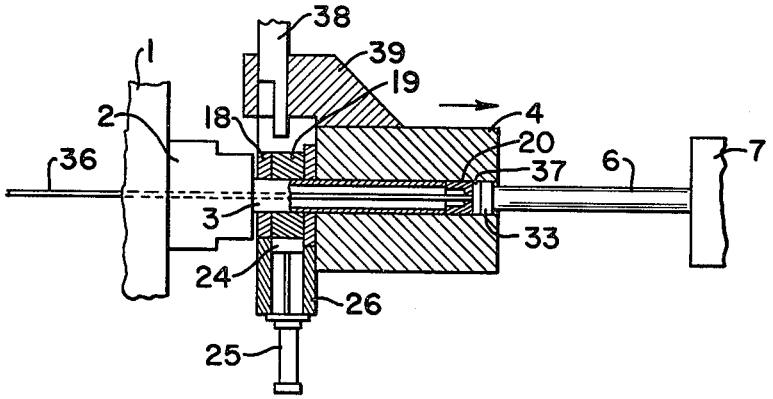
FIG. 12 is a vertical section similar to FIG. 3, but showing the position of the apparatus at the end of the extruding step.

A hydraulic cylinder 32 in sleeve 9 pushes the billet into container 4, where its rear end is engaged by a dummy block 33 as shown in FIG. 7. The dummy block is moved into position in any suitable manner, such, for example, by a swinging loader 34 carried by the container. There will be almost no clearance around the billet in the container passage, so there will be practically no air trapped between the billet and the passage wall, resulting in the absence of blisters on the surface of the extrusion. While the cylinder is pushing the billet into the container, the container and die slide are being moved forward, with the die slide passing over the die stem, which will cause the stem to push any extrusion butt and dummy block out of the back of the die slide and onto a tilting chute 35, from which they can roll away. The container and die slide then are retracted (FIG. 8) and, as shown in FIG. 9, the platen slide is moved back to its first position to line up the die stem with the billet in the container. At the same time, the die cassette 18 is lowered into operating position in the die slide and the slide is moved back to its inner position directly between the die stem and the container. The extrusion stem and the container then are moved forward (FIG. 10) and, as the container and die slide move over the die stem, the die enters the container and then the billet is extruded through the die, as shown in FIGS.

11 and 12, to form a rod 36 that passes out through the die stem, the platen slide and platen, leaving a relatively thin extrusion butt 37 and the dummy block 33 in the rear end of the container passage.

Figure 13:
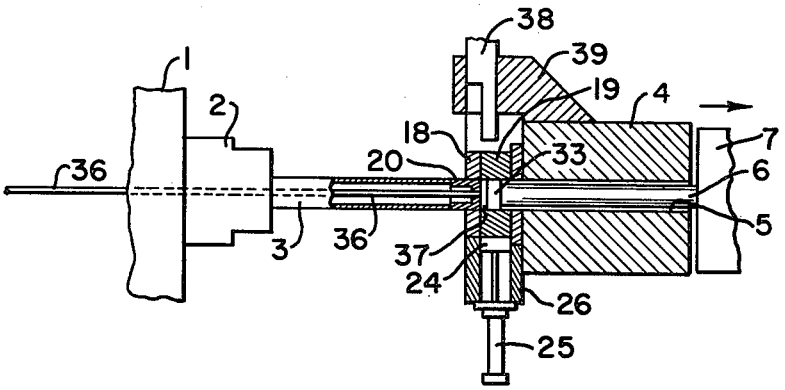
FIG. 13 is a vertical section showing the extrusion about to be sheared after completion of the skimming and container cleaning stroke.
Figure 14:
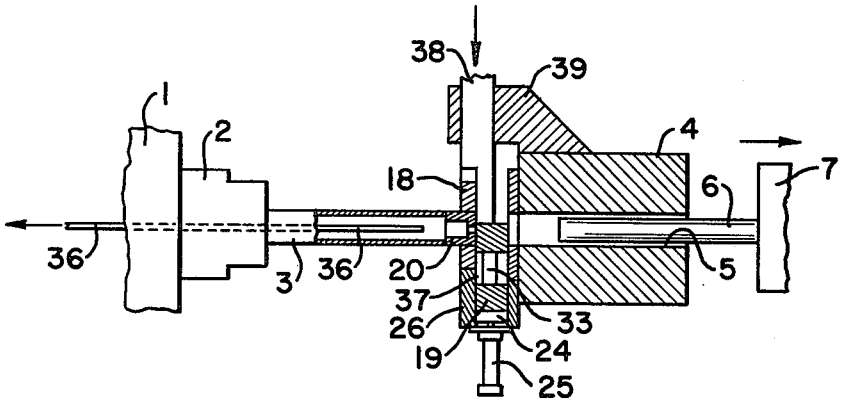
FIG. 14 is a similar view but showing the shearing completed.

Then, as shown in FIG. 13, the container and die slide are moved back around the extrusion stem to cause the rear cassette 19 to receive the butt and dummy block. At this time the rear cassette is located directly beneath a shear member 38 that is movable up and down in a support 39 attached to container 4. When the shear member is driven downwardly as fluid escapes from the underlying cylinder 25, the shear member pushes the rear cassette 19 down and the upper part of the cassette acts as a shear that shears the butt from the extruded rod as shown in FIG. 14, permitting the rod to be pulled forward out of the press. The cylinders 25 then lifts the cassette back into position in the die slide, as shown in FIG. 2, ready to repeat the cycle just described.

If a billet fails to extrude through the die, billet loader sleeve 9 can be moved into position in front of the container to receive the billet. If the billet cannot be ejected into the sleeve, the die can be replaced by a die with a large opening to extrude the billet with a low ratio of extrusion.

Although this invention has been described as a press for extruding rods, it will be understood that the invention applies equally well to a tube-extruding press wherein a hollow billet is extruded over a mandrel in a well known manner.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Extruding apparatus comprising a platen, a platen slide movable back and forth across the rear face of the platen, a die stem behind the platen secured at its front end to slide and extending rearwardly therefrom, a billet-receiving sleeve spaced laterally from said stem and secured at its front end to the slide and extending rearwardly therefrom, a billet container behind said slide provided with a billet-receiving passage therethrough and movable toward and away from the platen, said platen slide being movable from a first position in which said die stem is aligned with said container passage to a second position in which said sleeve is aligned with said container passage, means behind said sleeve in said first slide position for pushing a hot billet into the sleeve, a horizontal track secured to the front of said container transversely thereof, a die slide slidably mounted on said track and movable back and forth along the track from an inner position between the container passage and die stem when the platen slide is in said first position to an outer position at one side of the container in which the die slide is aligned with the die stem in said second position of the platen slide, said die slide having a passage extending therethrough from front to back, a vertically movable die cassette disposed in the front end of said die slide passage, a die mounted in said cassette, an extrusion stem behind the container and movable forward into said container passage to extrude a billet through said die, a vertically movable cassette for receiving a dummy block and extrusion butt disposed in said die slide passage behind the die cassette, a shear pusher frame rigidly connected with said container and projecting therefrom toward said platen, a shear member mounted in said frame and movable downwardly therein between said container passage and die stem when the platen slide is in said first position, said track being provided in front of said passage with an opening therethrough that is beneath said dummy block and butt cassette when the die slide is in its inner position, the bottom of the die slide having an opening therethrough directly above said track opening, said track and slide openings being large enough to receive the dummy block and butt receiving cassette when pushed down by said shear member to shear an extrusion, means below said last-mentioned cassette for raising it to its upper position in the die slide after said shearing, said track also being provided with an opening therethrough that is beneath said die cassette when the die slide is in its outer position aligned with said die stem, means below the die cassette for raising it above the other cassette when the die slide is in said outer position to permit the die slide to pass over the die stem to cause the die stem to eject a dummy block and extrusion butt from their cassette in the die slide when the container is moved toward the platen, means in said sleeve for pushing said hot billet from said sleeve in said second position of the platen slide into said container passage during said movement of the container toward the platen.

* * * * *